United States Patent [19]

Hoffman

[11] Patent Number: 4,772,233

[45] Date of Patent: Sep. 20, 1988

[54] LOW RESISTANCE CONNECTOR

[75] Inventor: David C. Hoffman, Los Gatos, Calif.

[73] Assignee: Trilogy Computer Development Partners, Ltd., Cupertino, Calif.

[21] Appl. No.: 533,904

[22] Filed: Sep. 19, 1983

[51] Int. Cl.[4] ..... H01R 13/11

[52] U.S. Cl. ..... 439/833; 439/886

[58] Field of Search ..... 339/259 R, 278 C

[56] References Cited

U.S. PATENT DOCUMENTS

| | | | |
|---|---|---|---|
| 1,597,189 | 8/1926 | Gero | 339/278 C |
| 1,936,469 | 11/1933 | Hill | 339/259 R |
| 2,346,831 | 4/1944 | Drury | 339/259 R |

FOREIGN PATENT DOCUMENTS

| | | | |
|---|---|---|---|
| 327618 | 4/1930 | United Kingdom | 339/259 R |

*Primary Examiner*—Joseph H. McGlynn

*Attorney, Agent, or Firm*—Townsend and Townsend

[57] ABSTRACT

A low resistance connector includes a pin and mating socket. The socket includes a central bore sized for mating engagement with one end of the pin. The socket includes a number of longitudinal slots extending into and parallel with the central bore so the central bore is surrounded by a number of flexible fingers. Intimate electrical contact between the outer surface of the pin and the internal surface of the socket bounding the central bore is achieved by annealing the fingers of the socket to a dead soft condition and by the placement of resilient snap rings around the fingers to bias the fingers against the pin.

15 Claims, 1 Drawing Sheet

LOW RESISTANCE CONNECTOR

BACKGROUND OF THE INVENTION

In many electronic systems the subassemblies that make up the system use large amounts of current at low voltages. For example, in large computer systems subassemblies often draw hundreds of amperes of current at only 5 volts. This combination of high current and low voltage requires, among other things, that the electrical path between the source of power and the subassembly have a very low resistance. If the resistance is too high, the resulting voltage drop, aside from efficiency considerations, can cause the voltage supplied to the subassembly to be too low.

Cables are often used to electrically connect the system components. In one typical arrangement each end of the cable has a lug attached to it. The lugs have a flat surface with a hole through it for bolting the lug at one cable end to the power supply and the lug on the other end of the cable to the power distribution system of the subassembly. The diameter of the cable is made large enough to give the desired low resistance.

There are several drawbacks with this prior art cable connection method. To remove and replace a subassembly, at least one of the lugs must be unbolted before the subassembly can be removed. This usually requires some time and the use of a wrench or other tool. Another disadvantage with using cable lugs is that the lugs provide a limited surface area for electrical contact between the lugs. An electrically conductive grease can be applied to the lug surfaces to reduce this contact resistance. However, even with such grease, surface contact resistance can be substantial Pin and socket type connectors are also commonly used in the prior art. They allow electrical connections to be easily and quickly made and broken. They may be used mounted to the ends of a cable in lieu of the lugs in the above-described cable connection system. However, the pin can be permanently affixed to either the power supply or the subassembly while the socket is permanently affixed to the other. As the subassembly is mounted within the system, the pin slides into the socket to make an electrical path for the current. Such pin and socket connecting systems are often preferred over cables since the pin and socket connectors can be designed to take up little room within the system. Unfortunately, known pin and socket connectors also have their disadvantages.

In the ideal pin and socket connector, the pin would make contact with the socket along the entire length and around the entire circumference of the pin. In practice, it is difficult to cause the pin to make such full contact with the socket. The contact resistance of the connector could be made smaller by making the pin and socket longer. However, space and strength limitations restrict how large the pin and socket can be.

One prior art pin and socket design uses flexing mechanisms, similar to small leaf springs, within the socket. When the pin is out of the socket, the opening within the socket is smaller than the pin. As the pin is inserted into the socket the flexing mechanisms are spread apart. In this design, which is expensive, contact between the pin and socket is made only at the surface of the flexing mechanisms thus limiting the area of surface contact. Also, the flexing mechanisms work-harden with use and eventually lose their spring force causing the contact resistance to increase.

Other pin and socket designs use woven sockets which expand as the pin is inserted or woven pins which compress as they are inserted into the socket. These types of connectors are also expensive and tend to have a limited life because of work-hardening.

SUMMARY OF THE INVENTION

The present invention is directed to an inexpensive, low resistance connector having long life. The connector includes a pin and a mating socket. The socket includes a central bore at its connector end sized for mating engagement with one end of the pin. The connector end of the socket includes a number of longitudinal slots extending parallel to the central bore so the central bore is surrounded by a number of flexible fingers. Intimate electrical contact between the outer surface of the pin and the internal surface of the socket bounding the central bore is achieved by annealing the fingers of the socket to a dead soft condition and by the placement of snap rings around the fingers thus biasing the fingers inwardly towards the external surface of the pin.

A primary feature of the invention is the provision of a socket having a number of flexible fingers surrounding the pin and biased toward the pin by one or more snap rings. Thus the electrical contact component, in this case the fingers, need not be resilient because resilience is provided by the circumscribing snap ring. Since the fingers need not be spring members, they can be annealed to a dead soft condition to enhance the intimate surface contact between the internal surface of the socket and the external surface of the pin. The spring member can be chosen for its resilient qualities and not its electrical conductive qualities so that work-hardening and other undesirable properties of prior art connectors are eliminated. Maximum surface contact between the socket and the pin is enhanced by making the longitudinal slots separating the fingers just wide enough to allow the fingers to be biased inwardly against the external surfaces of the pin.

Other features and advantages of the present invention will appear in the following description in which the preferred embodiment has been set forth in detail in conjunction with the accompanying drawing.

BRIEF DESCRIPTION OF THE DRAWING

The Figure is an exploded isometric view of the connector of the invention.

DETAILED DESCRIPTION OF THE PREFERRED EMBODIMENT

Figure 1:
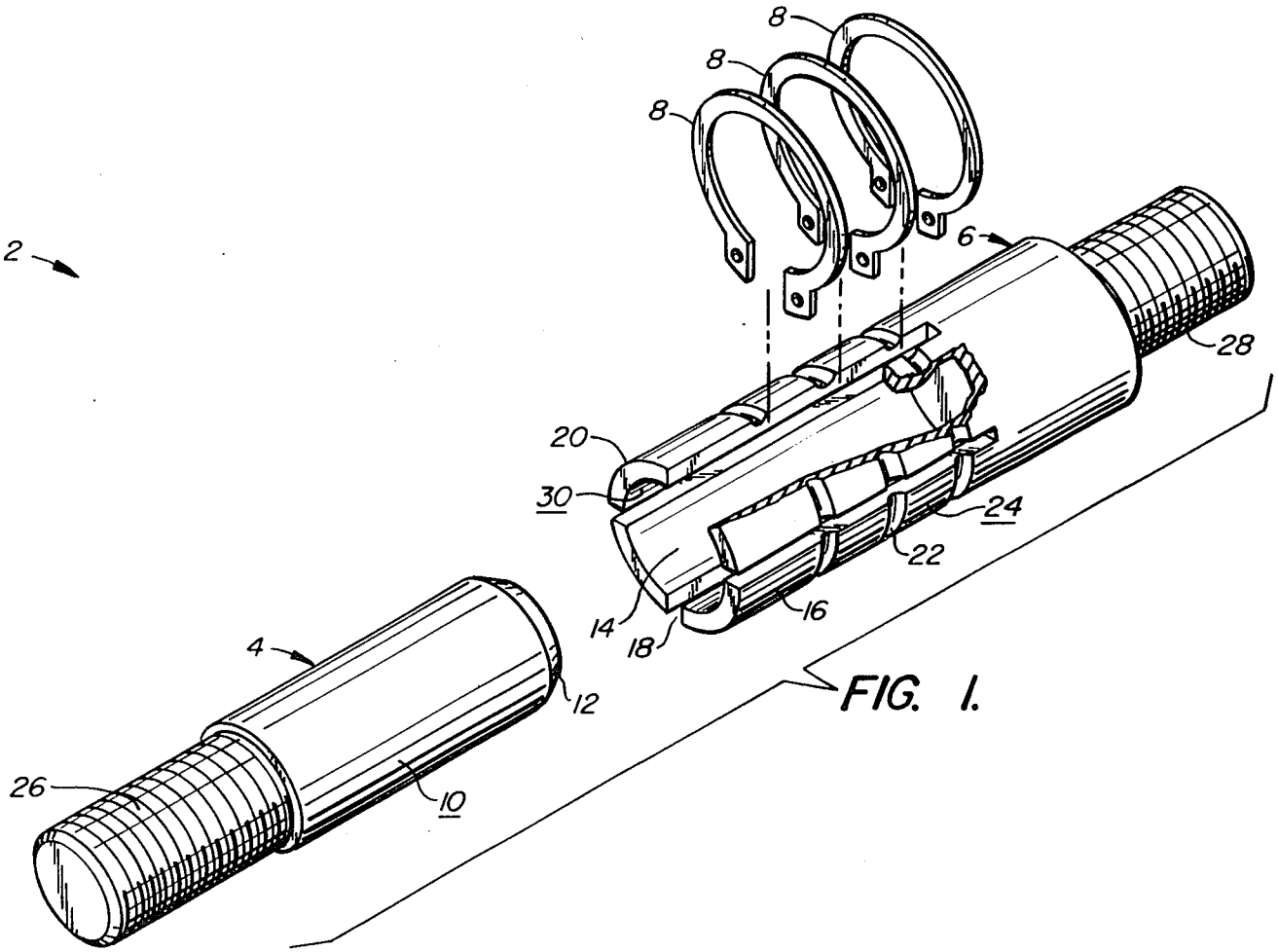

Turning now to the figure, connector 2 is shown to include a pin 4 for mating engagement with a socket 6 and about which snap rings 8 are mounted.

Pin 4 and socket 6 are generally cylindrical members made of copper or a copper-based alloy. Pin 4 has a cylindrical external contact surface 10 adjacent a front end 12 of pin 4. Front end 12 is chamferred for ease of insertion into a central bore 14 formed within one end 16 of socket 6.

Generally coextensive with bore 14 in socket 6 are four longitudinal slots 18 extending from at one end 16 of socket 6 and defining four fingers 20. Fingers 20 include three circular grooves 22 formed into the outer surface 24 of fingers 20. Grooves 22 are each sized and positioned for a receipt of a snap ring 8 therein. Pin 4 and socket 6 each have a respective threaded end 26, 28.

Ends 26, 28 are mounted to power distribution bars, not shown, of the components to be electrically connected. Other methods of electrically connecting pin 4 and socket 6 to their respective components can be used as well.

External surface 10 and central bore 14 are preferably machined to a high degree of smoothness and to the same nominal diameter. The resulting conformance of the surface contours helps to reduce the surface resistance between external surface 10 and the internal surface 30 defining central bore 14. To help keep surfaces 10, 30 from oxidizing, and thus reduce resistance due to oxidation of the surfaces, socket 6 and pin 4 can be plated with silver. As a further aid to promote the intimate surface contact between external surface 10 and internal surface 30, socket 6 is, after machining and plating, annealed to a dead soft condition. Once so annealed, fingers 20 lose their resilience. However, snap rings 8 resiliently bias fingers 20 against pin 4 so that proper intimate contact, and thus low electrical resistance, is achieved between surfaces 10 and 30.

In use, socket 6 and pin 4 are mounted to their respective equipment components by their threaded ends 26, 28. Snap rings 8 are mounted within grooves 22 to bias fingers 20 inwardly. After properly positioning the equipment components, pin 4 is pushed into central bore 14 until fully inserted. Chamferred front end 12 aids the initial insertion of pin 4 into central bore 14. Snap rings 8 bias internal surface 30 against external surface 10 to achieve maximum surface contact over virtually the entire mating area. Intimate surface contact is enhanced by the fact that fingers 20 are annealed to a dead soft condition.

Modification and variation can be made to the disclosed embodiment without departing from the subject of the invention as defined in the following claims. For example, a greater or lesser number of snap rings 8 can be used if desired. Also, external surfaces 10 and internal surfaces 30 can be made with cross-sectional shapes other than circular. Types of resilient retainers other than snap ring 8 can also be used to bias fingers 20 inwardly. Pin 4 may also be annealed if desired.

What is claimed is:

1. A low resistance electrical connector comprising:

a socket having a bore formed within one end thereof, said bore bounded by an internal electrical contact surface;

a pin having an external electrical contact surface sized for complementary mating engagement with said internal electrical contact surface;

said one end of said socket being segmented by at least one longitudinal axial slot extending from said one end to define at least one finger surrounding said central bore, said finger being of soft annealed metal so to aid intimate electrical contact with the pin; and a resilient fastener constrictingly mounted about said at least one finger to bias said finger toward said central bore to enhance electrical contact between said internal and external surfaces.

2. The electrical connector of claim 1 wherein said segmented one end is tubular.

3. The electrical connector of claim 1 wherein said fastener includes a snap ring configured to substantially circumscribe said one end and bias said at least one finger inwardly toward said pin.

4. The electrical connector of claim 1 wherein said socket is of soft annealed metal.

5. The electrical connector of claim 1 wherein said soft annealed metal is copper or a copper based alloy.

6. The electrical connector of claim 1 wherein said socket is plated with silver.

7. The electrical connector of claim 1 wherein said one end is segmented by a pluarlity of slots to define a plurality of flexible fingers.

8. The electrical connector of claim 1 wherein said external and internal contact surfaces have circular cross-sectional shapes.

9. The electrical connector of claim 8 wherein said internal contact surface is cylindrical.

10. The electrical connector of claim 9 wherein said external contact surface is cylindrical.

11. The electrical connector of claim 1 further comprising a positioning groove circumscribing said at least one finger for placement of said fastener therein.

12. The electrical connector of claim 11 wherein said groove is circular.

13. The electrical connector of claim 12 comprising a plurality of circular snap ring fasteners positoned within a plurality of said positioning grooves.

14. An electrical connector comprising:

a generally cylindrical socket having a tubular end, said tubular end defining a plurality of fingers separated by longitudinal grooves, said fingers being an annealed copper or copper alloy;

a generally cylindrical pin sized for complementary mating engagement within said tubular end; and a resilient snap ring circumscribing said fingers, said snap ring sized to bias said fingers inwardly to enhance the electrical contact between the fingers and the pin.

15. The electrical connector of claim 14 wherein said socket and pin are plated with silver to remove oxidation resistance and said socket includes a circular groove formed in an outer surface thereof for receipt of said snap ring.

* * * * *